US006439575B1

(12) United States Patent
Castellanos

(10) Patent No.: US 6,439,575 B1
(45) Date of Patent: Aug. 27, 2002

(54) FOOTBALL GAME USING A TRIANGULAR GAME PIECE WITH NUMERICAL VALUES

(76) Inventor: Ruben Castellanos, 1039 Cesar Chavez Ave., Los Angeles, CA (US) 90033

( * ) Notice: Subject to any disclaimer, the term of this patent is extended or adjusted under 35 U.S.C. 154(b) by 0 days.

(21) Appl. No.: 09/760,140

(22) Filed: Jan. 11, 2001

(51) Int. Cl.[7] ..... A63F 3/00; A63F 7/06

(52) U.S. Cl. ..... 273/317.5; 273/126 R; 273/108.4; 273/277; 273/288

(58) Field of Search ..... 273/126 R, 108.1, 273/108.4, 108.41, 244, 247, 259, 277, 288, 353, 317.1, 317.5, 440, 146, 274, 143 R; D21/318, 357, 386; 473/438

(56) References Cited

U.S. PATENT DOCUMENTS

| | | | | |
|---|---|---|---|---|
| 1,161,649 | A | * | 11/1915 | Fitzgerald |
| 1,492,737 | A | * | 5/1924 | Meyer |
| 1,517,113 | A | * | 11/1924 | Greene |
| 3,649,017 | A | * | 3/1972 | Kirkpatrick |
| 4,555,114 | A | | 11/1985 | Dozier |
| D294,508 | S | * | 3/1988 | Kight |
| 4,762,323 | A | | 8/1988 | Blagg |
| 4,872,679 | A | * | 10/1989 | Bohaski |
| 4,989,879 | A | * | 2/1991 | Nigh |
| D316,279 | S | | 4/1991 | Reynolds |
| D323,011 | S | | 1/1992 | Roberts |
| 5,110,127 | A | * | 5/1992 | Potter |
| 5,257,783 | A | * | 11/1993 | Callaghan |
| 5,440,858 | A | | 8/1995 | Hinkes |
| 5,451,050 | A | * | 9/1995 | Charles |
| 5,556,095 | A | | 9/1996 | Stites |
| 5,570,888 | A | | 11/1996 | Robinson et al. |
| 5,673,912 | A | | 10/1997 | Bonk |
| 5,687,966 | A | | 11/1997 | Barnhart et al. |

* cited by examiner

*Primary Examiner*—Sebastiano Passaniti
(74) *Attorney, Agent, or Firm*—Gene Scott-Patent Law & Venture Group

(57) ABSTRACT

A game apparatus and method of play by a pair of opponents, uses a game board on a level surface or field. A game board indicia resembles an American-Football field with two spaced apart and opposing end zone front lines. A triangularly shaped and flatly formed game piece provides numerical values to its three corners. The game piece is suitable for sliding on the game board, and is thrust back and forth on the board by the contestants or opponents, with game piece generally in contact with the game board, until the game piece is positioned on one of the end zone front lines. Values or scores are assigned to the opponents corresponding to how the game piece is situated on the end zone front lines. Additional points may be acquired through aerial thrusts of the game piece through an upright goal situated at or in the end zones of the game board.

4 Claims, 3 Drawing Sheets

FOOTBALL GAME USING A TRIANGULAR GAME PIECE WITH NUMERICAL VALUES

BACKGROUND OF THE INVENTION

1. Field of the Invention

This invention relates generally to board or street games using a field of play and a set of opposing goals and more particularly to a specific game of this type with particular methods of play and scoring simulating that of American Football.

2. Description of Related Art

The following art defines the present state of this field:

Reynolds, U.S. D315,279 describes a projectile game piece.

Roberts, U.S. D323,011 describes a football game piece.

Dozier, U.S. Pat. No. 4,555,114 describes a puck for use in a parlor game played on a table top or the like in which the principal object is to flip the puck with a finger and lag it to overhang the opposite edge of the table; the puck comprises a body of foam material with vertical sides with a low density of approximately three pounds per cubic foot and in the shape of an acute triangle having sides somewhat more than two inches; corners of said triangle are rounded to a radius of about one-quarter inch; the puck is about one-half inch thick and has a bottom surface layer of non-woven nylon fabric with a coefficient of sliding friction on clean, dry glass of approximately 0.8. The top of the foam body has adhered thereto a triangular piece of plastic sheet material on which advertising or other indicia may be printed.

Blagg, U.S. Pat. No. 4,752,323 describes a board game representing a sport, such as football. The game has a playing board, which represents the playing field. Player disks represent players, and a ball disk represents the football. The ball disk has beveled edges, so that it will slide over the player piece when the ball disk is propelled across the playing board. The ball disk is propelled by thumping the ball disk with a finger.

Hinkes, U.S. Pat. No. 5,440,858 describes a system and process for forming an instant, fixedly attached but removable game court on any type of concrete, black-top, asphalt, or like outdoor hard surface, which allows a game involving frictional contact of the players with the hard surface to be played on the game court without the removal of the game court, and the subsequent easy removal of the game court by rinsing of the hard surface with water from a conventional garden hose or by natural rainwater.

Stites, U.S. Pat. No. 5,556,095 describes a game board with an elongated rectangular shaped member having a top side. At each end, a series of axial scoring numbers 1, 2, 3, 4 and a series of lateral scoring numbers 1, 2, 3 are formed on the top side.

Robinson et al., U.S. Pat. No. 5,570,888 describes a football game and football game apparatus in which a simulated football is thumped by the finger of a player to place the football in play and move the football to various locations on a board provided with the game. The football apparatus includes a game board having a planar playing surface, yard lines and goal lines marked thereon, movable goal posts, and a trough adjacent to the goal lines to catch the simulated football. The game board may be supported by legs, or placed on the top of a table.

Bonk, U.S. Pat. No. 5,673,912 describes a table football game which comprises a table football having a flat configuration. The table football game further comprises a table which comprises a first table edge and a second table edge. The first table edge and the second table edge are positioned on opposing sides of the table. The table football game further comprises at least one first player performing an action selected from a group consisting of first player's kick, first player's goal, first player's palm, first player's finger shooting, and first player's palm shooting. The table football game further comprises at least one second player performing an action selected from a group consisting of second player's kick, second player's goal, second player's palm, second player's finger shooting, and second player's palm shooting. A result occurs from the action performed by the at least one first player and the at least one second player. The result is selected from a group consisting of table football touchdown having table football touchdown points associated therewith, table football extra point, table football two-point conversion, table football field goal having table football field goal points associated therewith, table football bonk having table football bonk points associated therewith, and winning points.

Barnhart et al., U.S. Pat. No. 5,687,996 describes a football game piece in the form of a triangular shaped, relatively flat playing piece having equal length side edges and a longer side edge, and with the corners formed by the side edges being relatively rounded and squared-off for safety purposes. In addition, the squared-off corner prevents the game piece from sliding when the game piece is in an upright position on the squared-off corner. The game piece is formed by a core section made of lightweight foam material, and first and second woven fabric veneers having relatively slick outer surfaces, to allow game piece to slide across a table, game board or other non-porous surface.

The prior art teaches the use of games and game pieces for use in finger and foot manipulated games and indeed game pieces for such games as in Reynolds and Roberts as defined above, but does not teach a game with game structure and rules of play as defined herein in simulating American Football. The present invention fulfills these needs and provides further related advantages as described in the following summary.

SUMMARY OF THE INVENTION

The present invention teaches certain benefits in construction and use which give rise to the objectives described below.

A game apparatus and method of play by a pair of opponents, uses a game board on a level surface or field. A game board indicia resembles an American-Football field with two spaced apart and opposing end zone front lines. A triangularly shaped and flatly formed game piece provides numerical values at its three corners. The game piece is suitable for sliding on the game board, and is thrust back and forth on the board by the contestants or opponents, with game piece generally in contact with the game board, until the game piece is positioned on one of the end zone front lines. Values or scores are assigned to the opponents corresponding to how the game piece is situated on the end zone front lines. Additional points may be acquired through aerial thrusts of the game piece through an upright goal situated in each of the end zones of the game board.

A primary objective of the present invention is to provide an apparatus and method of use of such apparatus that provides advantages not taught by the prior art.

Another objective is to provide such an invention capable of simulating American Football play with only as few as two individual opponents.

A further objective is to provide such an invention capable of being played through hand or foot manipulation of a game piece.

A still further objective is to provide such an invention capable of simulating the scoring process found in American Football play.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
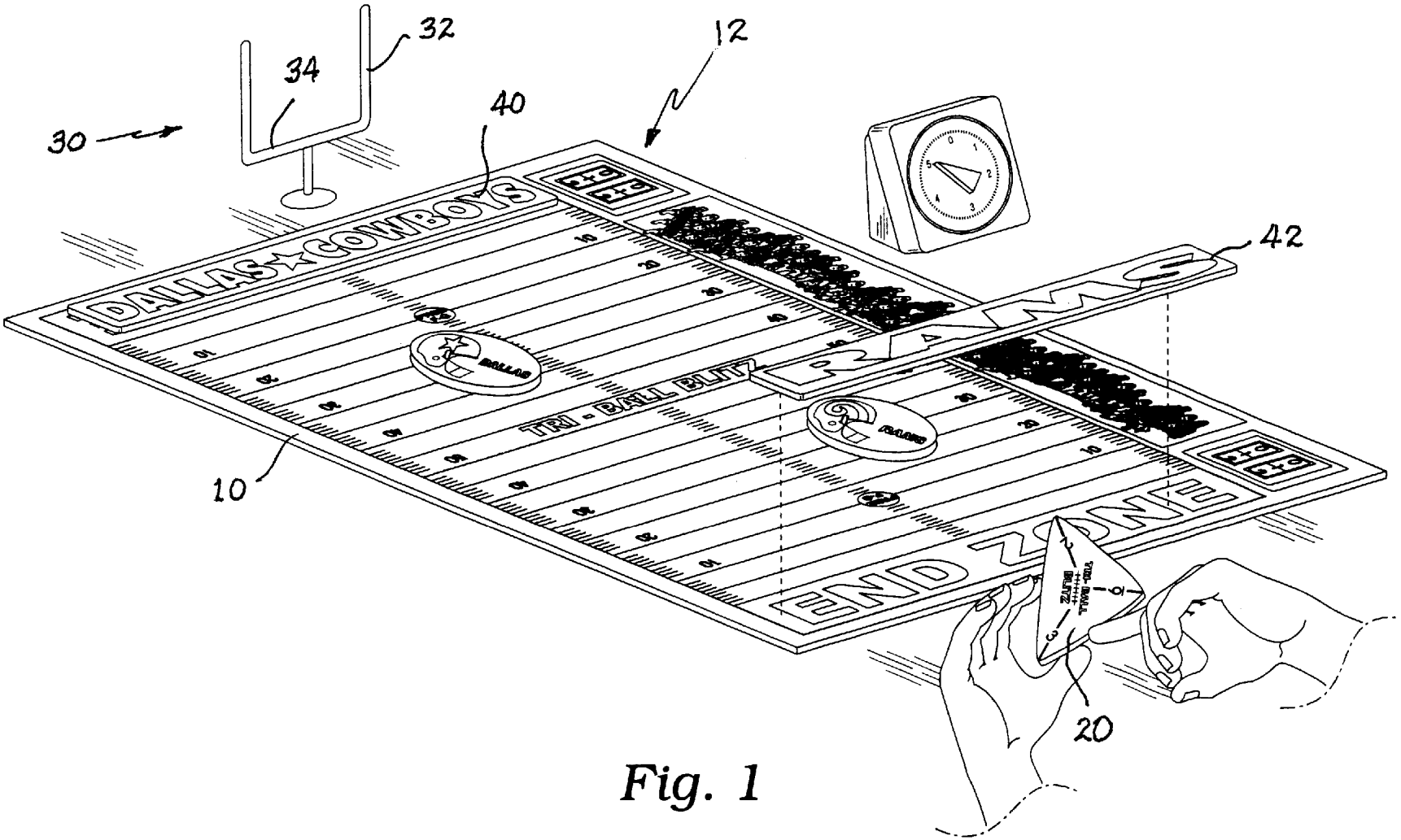
FIG. 1 is a perspective view of the preferred embodiment of the invention.
Figure 3:
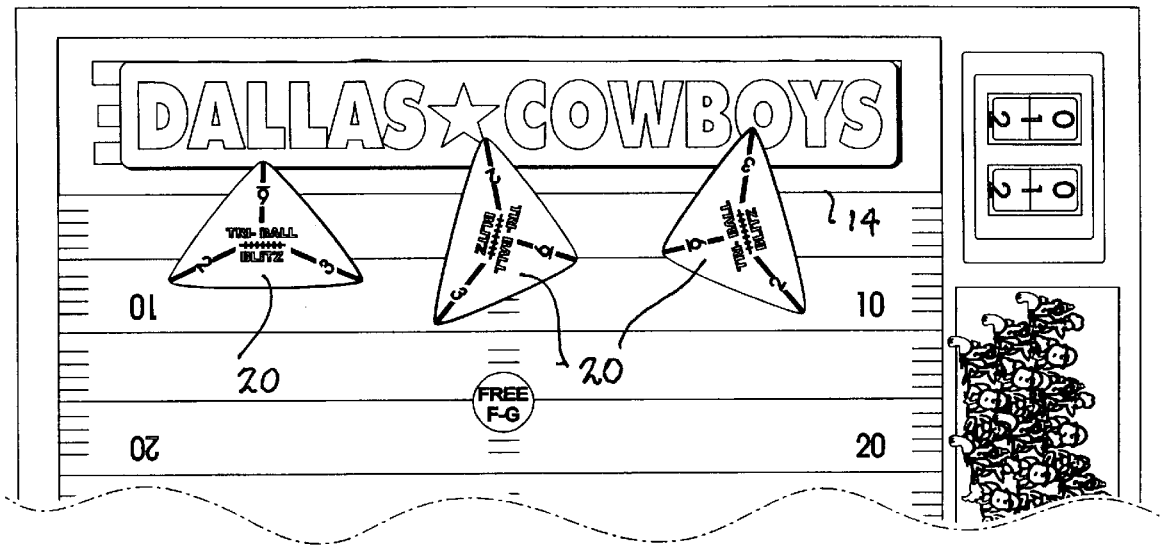
FIG. 3 is a plan view of an end zone thereof showing three possible positions of a game piece in play.
Figure 4:
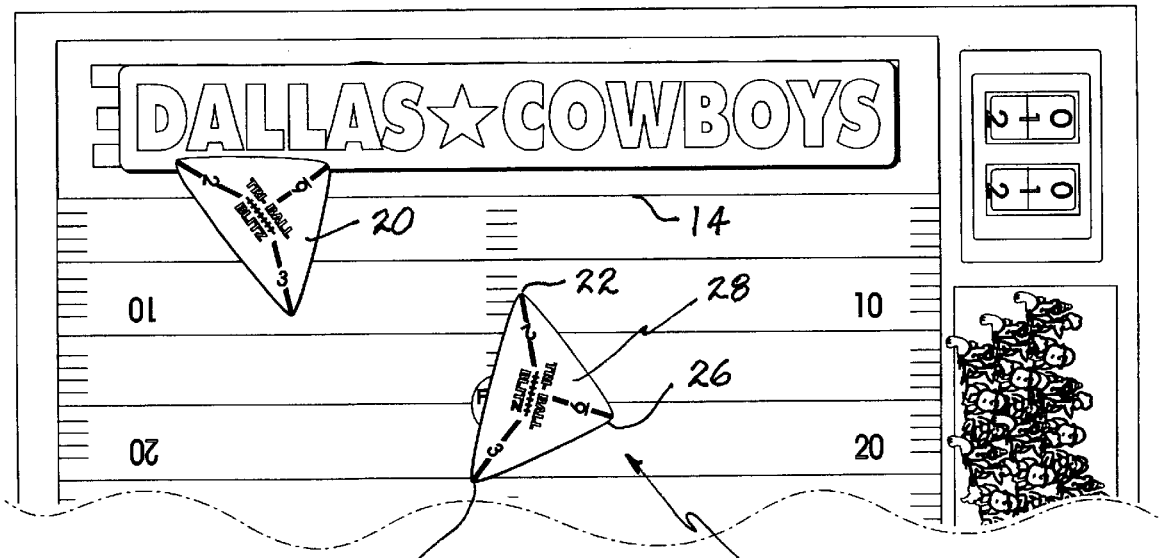
FIG. 4 is a similar plan view thereof showing alternate positions of the game piece.

A game apparatus of the invention comprises a game board 10 for placement on any level surface. The game board 10 may be constructed of plastic or paper sheet stock and may be flexible or rigid. In this embodiment the game board 10 may be placed on a table or similar object for support. Alternately, the game board 10 may be drawn in the street or on a sidewalk with chalk or similar materials (not shown). Preferably, the game board 10 provides a game board indicia 12 resembling an American-football field as shown in the figures. A triangularly shaped and flatly formed game piece 20 has three corners 22, 24, 26. The game piece 20 is suitable, by its construction and surface finish, for sliding on the game board 10. The game piece 20 provides a game piece indicia 28 indicating unique numerical values associated with each of the three corners 22, 24, 26 of the game piece 20, as shown in FIG. 4. These values are preferably 6, 3 and 2 respectively as will become clear in the description of use and method of play in the following. Preferably, the game apparatus further comprises at least one self standing field goal 30 having a pair of spaced apart uprights 32 extending vertically from a cross bar 34 as shown in FIG. 1. Still further the apparatus preferably comprises at least one pair of end zone pieces 40, 42, where each of the end zone pieces provides an indicia defining a team name as most clearly is shown in FIGS. 3 and 4. The purpose of the end zone pieces 40, 42 is to enable a player to more closely associate with a professional or other actual team of choice while playing the game of the present invention. In a preferred embodiment, the end zone pieces are fitted, like puzzle parts into tight fitting depressions defining the end zone areas of the playing board or field.

Figure 2:
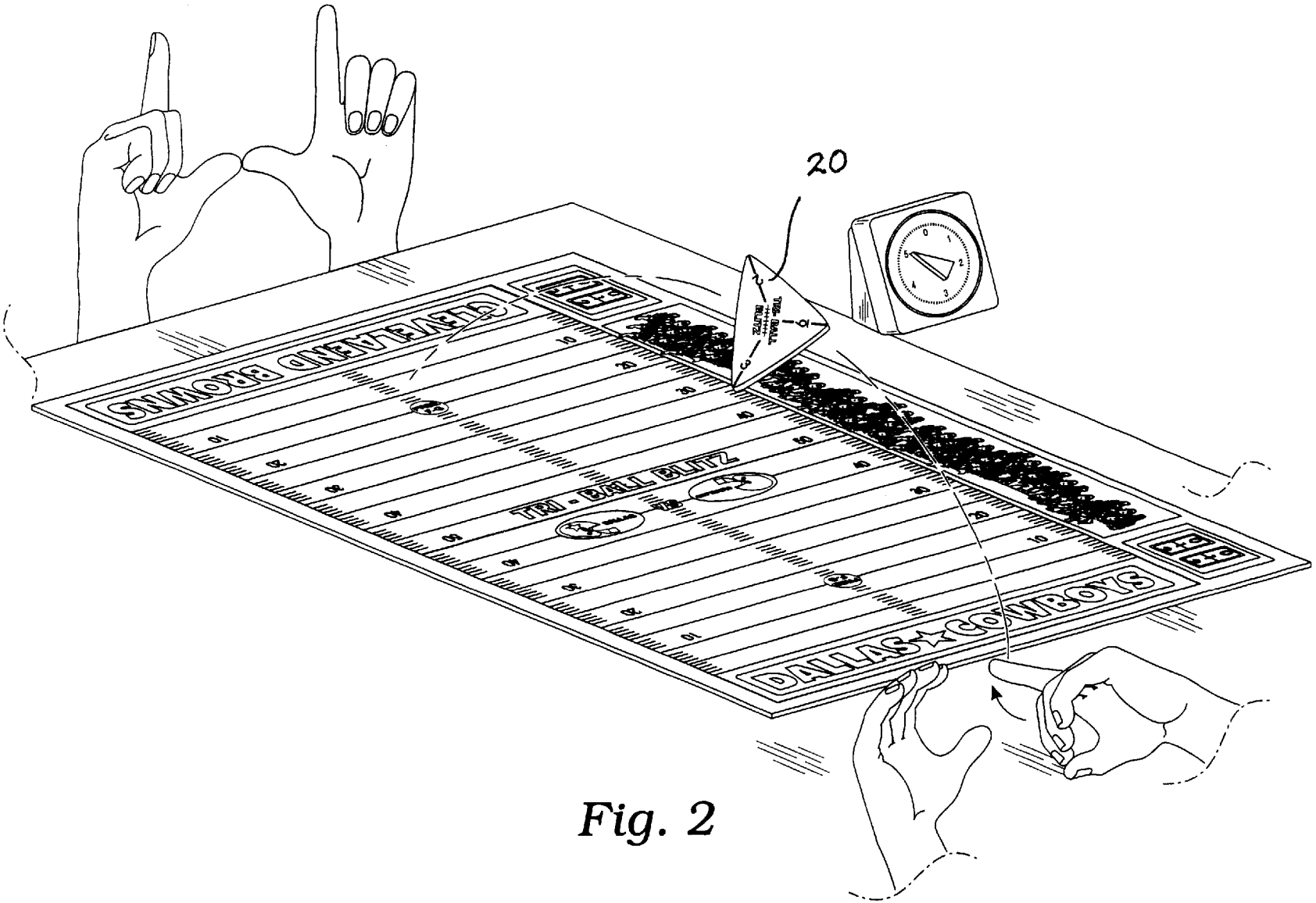
FIG. 2 is a further perspective view thereof.

A preferred method of game play is carried out by a first and a second opponents who's hands are depicted in FIG. 2. Alternately, teams of two pairs of players may enter into the play of the invention. However, only one individual may enter into play at one time as will be described below.

The method comprises providing the game board 10 and triangularly shaped game piece 20 previously defined above. Play is defined by a process of thrusting the game piece 20 in contact with the game board 10 by each of the opponents or their seconds, alternately, until the game piece 20 is positioned on one of a pair of spaced apart end zone front lines 14 (FIGS. 3 and 4). When this occurs a value, in game points, corresponding to how the game piece 20 is situated on the end zone front line 14 is assigned to the opponent making the thrust. In a table-top sized version of the present invention the game piece 20 is of a size and weight, as shown in the figures so as to be manipulated by flicking a finger to thrust the game piece in a desired directions. This type of finger flicking is well known to youngsters in games using marbles and soda bottle caps where these objects are projected through the use of a finger thrust. Alternately, when the game is enlarged on the sidewalk, for instance, the game piece may be much larger and heavier and may be thrust by kicking. It should be clear that the following description of play and scoring may easily be applied to the game as played in any practical scale.

The method of scoring corresponds roughly to that of American football and includes a game point value of 2 points when only the 2 point game piece corner is positioned in an end zone, a game point value of 3 points when only the 3 point game piece corner is positioned in an end zone, and a game point value of 6 points when only the 6 point game piece corner is positioned in an end zone. This is clearly shown by the center, right side and left side game pieces in FIG. 3 and corresponds to a safety, field goal and touchdown in American Football play. Notice that only the individual corner of the game piece 20 is positioned within the end zone of the playing board, while the remainder of the game piece 20 must be positioned on the playing field in order to award points. If no portion of the game piece 20 protrudes into the end zone then a thrust does not generate any points. Also, if a thrust places the game piece fully within the end zone or beyond, no points are generated.

To simulate an attempt to achieve an "extra-point" after a touchdown (6 point score), the method of the present invention, further comprises the step of thrusting the game piece 20 through the air toward the opponent's field goal 30 and assigning a game point value of 1 point when the game piece passes through the uprights of the field goal 30. This is best seen in FIG. 2. If the game piece 20 does not pass through the goal 30 prior to touching the surface, then zero points are awarded. Please notice that, as in FIG. 2, the goal 30 may be replaced by the hands of ones opponent.

In the process of thrusting the game piece 20 toward the end zone front line 14 it is possible that the game piece may come to rest on the line 14 in a manner as shown at the left in FIG. 4. In this case, a game point value of one-half of the sum of the values assigned to the two opposing corners of the game piece which lay within the end zone is awarded. In the present case a value of ½(6+2) is awarded, or 4. Clearly further rules of play may be added to the game in order to make it more closely correspond to the game of American Football. For instance a set of two "halves" or four "quarters" may be used to gauge the duration of a single game, wherein a timer may be used to control playing duration. However, the primary distinct and novel aspect of the present invention is the use of value assignments to the corners of the triangular game piece and the method of assignment of scores related to the movement of the game piece relative to features of the board and its associated accessories.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method of game play by a first and a second opponent comprising: providing a game board for placement on a level surface, the game board providing a game board surface resembling an American football field including spaced apart and opposing end zone lines; providing a tri-cornered, flatly formed game piece, the game piece adapted for sliding on the game board, the game piece providing numerical values of 6, 3 and 2, one of the numerical values associated with each one of the three corners of the game piece; thrusting the game piece in contact with the game board by each of the opponents, alternately, until the game piece is positioned on one of the zone lines; assigning a value in game points depending on which of the corners of the game piece is situated beyond said zone line; and after each score of 6, thrusting the game piece through the air toward a field goal and assigning a game point value of 1 point when the game piece passes through the field goal and no points when the game piece does not pass through the field goal, whereby said method of game play simulates actual American football in action and scoring.

2. The method of claim 1 further comprising assigning a game point value of 2 points when only the 2 point game piece corner is positioned on a zone line.

3. The method of claim 1 further comprising assigning a game point value of 3 points when only the 3 point game piece corner is positioned on a zone line.

4. The method of claim 1 further comprising assigning a game point value of 6 points when only the 6 point game piece corner is positioned on a zone line.

* * * * *